US005183984A

United States Patent [19]

Nakagawa

[11] Patent Number: 5,183,984

[45] Date of Patent: Feb. 2, 1993

[54] COOKING APPARATUS WITH COOKING INFORMATION DISPLAY MEANS

[75] Inventor: Tatsuya Nakagawa, Yokohama, Japan

[73] Assignee: Kabushiki Kaisha Toshiba, Kawasaki, Japan

[21] Appl. No.: 841,260

[22] Filed: Feb. 24, 1992

Related U.S. Application Data

[63] Continuation of Ser. No. 299,374, Jan. 23, 1989, abandoned.

[30] Foreign Application Priority Data

Jan. 21, 1988 [JP] Japan ..... 63-9683
Jan. 21, 1988 [JP] Japan ..... 63-9684
Jan. 21, 1988 [JP] Japan ..... 63-9685

[51] Int. Cl.[5] ..... H05B 6/68

[52] U.S. Cl. ..... 219/10.55 M; 219/10.55 E; 219/506; 99/325; 340/794

[58] Field of Search ..... 219/10.55 B, 10.55 R, 219/10.55 E, 10.55 M, 506; 99/451, 325; 340/711, 789, 794, 798, 799

[56] References Cited

U.S. PATENT DOCUMENTS 4,255,639 3/1981 Kawabata et al. ..... 219/10.55 B
4,375,586 3/1983 Ueda ..... 219/10.55 B
4,405,991 9/1983 Stanley ..... 219/10.55 R
4,406,945 9/1983 Ueda et al. ..... 219/506
4,625,086 11/1986 Karino ..... 219/10.55 B
4,816,635 3/1989 Edamura ..... 219/10.55 B
4,841,125 6/1989 Edamura ..... 219/506

*Primary Examiner*—Philip H. Leung
*Attorney, Agent, or Firm*—Foley & Lardner

[57] ABSTRACT

A cooking apparatus has necessary cooking functions and comprises a cooking information storage for storing names of materials of each dish to be cooked by the apparatus and quantities per person of the materials of the dish, a display for displaying at least the quantities of the materials, and input switch for inputting the number of persons to be served with the dish, an operating device for calculating quantities of the materials of the dish for the inputted number of persons according to the quantities of the materials per person stored in the storage, and a data correction device for correcting the calculated quantities and providing optimum visible display data intuitionally understandable by the user to the display.

4 Claims, 8 Drawing Sheets

FIG.4a

12 : 00

WARMING

THAWING

THAWING & WARMING

MICROWAVE COOKING

GRILLING

OVEN

MENU

FIG.4b

MENU SELECTION

GRILLED HORSE MACKEREL WITH SALT

GRILLED MACKEREL WITH SALT

POTATO SOUP

FLATFISH WRAPPED WITH KELP

SEA BREAM & RICE

CANCEL

FIG.4c

POTATO SOUP

RECIPE

MATERIALS

NO. OF PERSONS

CANCEL

FIG.4d

INPUT NO. OF PERSONS

| | |
|---|---|
| 1 PER. | 6 PER. |
| 2 PERS. | 7 PERS. |
| 3 PERS. | 8 PERS. |
| 4 PERS. | 9 PERS. |
| 5 PERS. | 10 PERS. |

CANCEL

FIG.4e

POTATO SOUP

RECIPE

MATERIALS

NO. OF PERSONS

CANCEL

FIG.4f

POTATO 200g

BEEF 70g

SOUP 1ℓ

SALT 2 QUARTER

⋮

FIG.7

| | |
|---|---|
| • • • | |
| (ORIGINAL UNIT) | mℓ |
| (CONVERSION UNIT) | ℓ |
| (CONVERSION VALUE) | 1/1000 |
| (USABLE OPTIMUM MINIMUM) | 1000 |
| (USABLE OPTIMUM MAXIMUM) | ∞ |
| • • • • • | |

VALUE ROUNDING PROCESS

COOKING APPARATUS WITH COOKING INFORMATION DISPLAY MEANS

This application is a continuation of application Ser. No. 07/299,374, filed Jan. 23, 1989 now abandoned.

BACKGROUND OF THE INVENTION

1. Field of the Invention

The present invention relates to a cooking apparatus such as a microwave oven, and particularly to a cooking apparatus which is able to provide correct cooking information for given number of servings and display the information in the most suitable manner.

2. Description of the Prior Art

As dietary culture has improved in recent years, high-performance cooking apparatuses such as microwave ovens which can cook various dishes with a single unit have been developed and spread into general family use. This tendency may continue in the future.

To effectively use such high-performance cooking apparatuses to make delicious dishes, it is important to correctly grasp cooking information related to the dishes being cooked. This information may include; a menu of dishes that can be cooked by the cooking apparatuses, quantities of food materials of each dish necessary for preparing the dish for a given number of persons to be served the dish, and recipes for the dishes.

Conventionally, a user of such a cooking apparatus refers to cookbooks, etc., to confirm cooking information related to a dish. This is laborsome. In addition, cookbooks are usually based on standard models in deciding quantities of food materials of their dishes. Therefore, the user shall properly convert the quantities written in the books into those needed by the user. This is also laborsome.

The prior art cooking apparatuses are, therefore, strongly required to have a function of providing correct and easily understandable cooking information for a given number of servings of each dish.

SUMMARY OF THE INVENTION

An object of the present invention is to provide a cooking apparatus which can provide correct cooking information of each dish for a user of the apparatus in cooking the dish with the apparatus for a given number of persons to be served with the dish.

Another object of the present invention is to provide a cooking apparatus which can process cooking information of food materials and display the information in the most suitable manner.

Still another object of the present invention is to provide a cooking apparatus which can provide correct cooking information for a given number of servings of a dish to be cooked, select the most suitable units for the information and display the information with the selected units.

Still another object of the present invention is to provide a cooking apparatus which can provide correct cooking information for a given number of servings of a dish to be cooked and display the information with fractional numbers.

Still another object of the present invention is to provide a cooking apparatus which can provide correct cooking information for a given number of servings of a dish to be cooked, round up or down values related to the information, and display the rounded up or down values with character strings corresponding to the rounding up or down operations.

According to an aspect of the present invention, a cooking apparatus has necessary cooking functions and comprises a cooking information storage for storing names of materials of each dish to be cooked by the apparatus and quantities of the materials needed for preparing the dish per person, a display for displaying at least the quantities of the materials needed for cooking the dish, an input switch for inputting the number of persons to be served with the dish, and operating device for calculating the quantities of the materials needed for preparing the dish for the inputted number of persons according to the quantities of the materials per person stored in the cooking information storage, and a display data correction device for correcting the calculated quantities to provide a most suitable visible display data which may be intuitionally understandable by the user of the apparatus and supply the data to the display.

The correction for providing the optimum visible display data comprises an optimum unit selecting process for selecting the most suitable units with respect to the quantities of the materials calculated for the inputted number of persons and converting the quantities with the selected units, and at least either of a process of generating fractional numbers according to the converted quantities with the selected units or a process of rounding up or down the converted quantities with the selected units and adding character strings corresponding to the rounding up or down operations to the quantities which have been rounded up or down.

These and other objects, features and advantages of the present invention will be more apparent from the following detailed description of preferred embodiments in conjunction with the accompanying drawings.

BRIEF DESCRIPTION OF THE DRAWINGS

FIGS. 4(*a*) to 4(*f*) are views showing display states of the microwave oven;

FIG. 7 is a view showing an example of unit conversion tables;

DETAILED DESCRIPTION OF THE EMBODIMENTS

Figure 1:
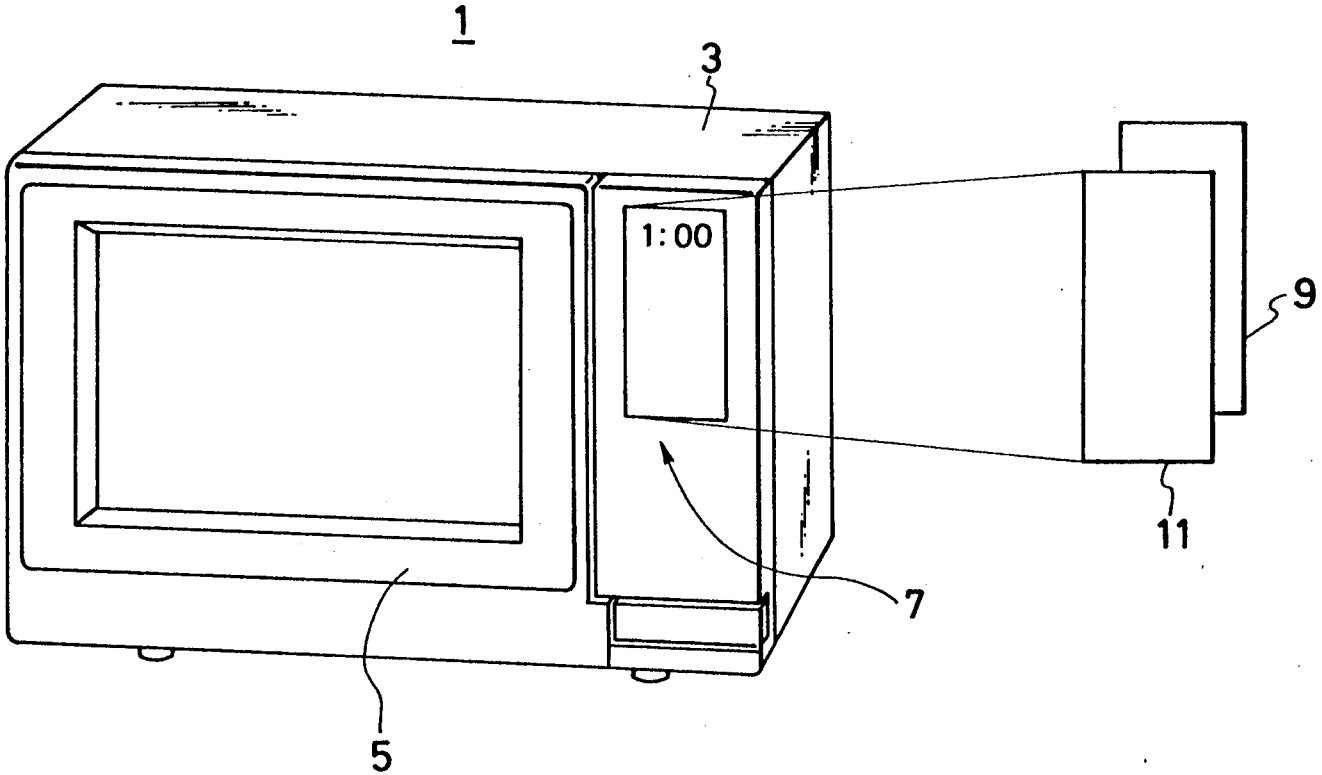
FIG. 1 is an external view of a microwave oven according to an embodiment of the present invention.

FIG. 1 is an external view of a microwave oven 1 according to the present invention.

The microwave oven 1 comprises a box-like main body 3, a door 5 for a cooking chamber, and a display and control portion 7. The display and control portion 7 comprises a display portion 9 which may be a liquid crystal display plate, and an input means 11 which may be a transparent switch laid over the display portion 9.

The display portion 9 is used to properly display cooking information for cooking a dish for a given number of persons, under the control of a control and operation portion 13 to be described later in detail.

The input means 11 is controlled by the control and operation portion 13 and manipulated by a user to input instructions.

Figure 2:
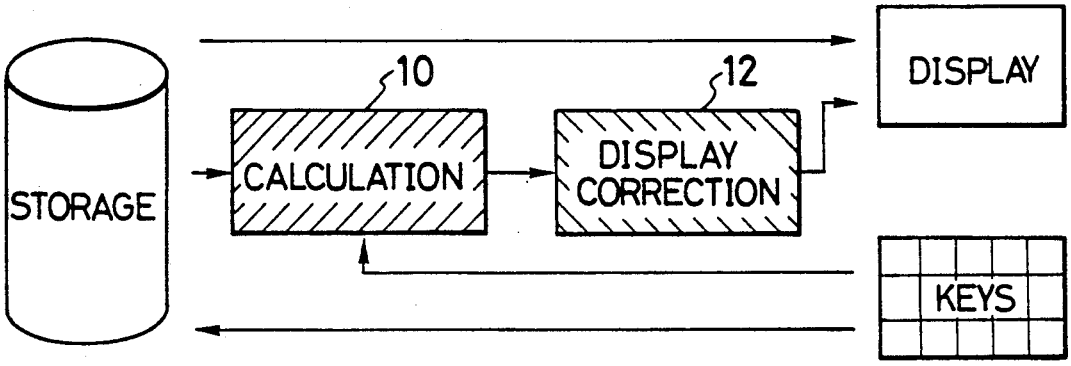
FIG. 2 is a block diagram showing concept of display correcting process of cooking information according to the present invention.

FIG. 2 shows a concept of the microwave oven 1 of the present invention. The microwave oven 1 calculates quantities of food materials necessary for preparing a required dish for a given number of persons to be served with the dish (Step 10), and corrects the calculated quantities to provide optimum visible display data that are understandable by the user intuitionally (Step 12).

Figure 3:
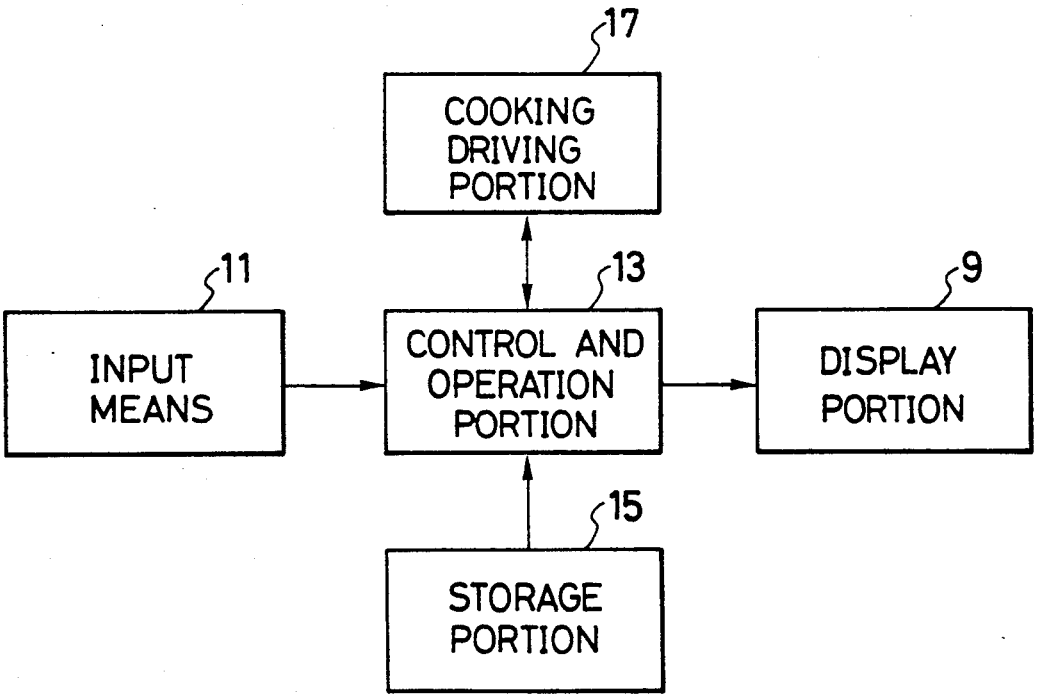
FIG. 3 is a circuit block diagram of the microwave oven according to the present invention.

As shown in FIG. 3, the microwave oven 1 is controlled by the control and operation portion 13 which may be a microcomputer. To the control and operation portion 13, the display portion 9, the input means 11, a storage portion 15 and a cooking driving portion 17 are each connected.

The storage portion 15 forms a cooking information storage means, and stores a cooking driving process program, a quantity calculating process program and a display correcting process program, etc., for the use of the control and operation portion 13. The storage portion 15 further stores cooking information such as names of dishes that can be cooked by the microwave oven 1, names of food materials necessary for the respective dishes, quantities per person of the respective materials of each dish, recipes of the respective dishes, and conversion tables to be used for the optimum unit selecting process.

The cooking driving portion 17 is controlled by the control and operation portion 13 according to the cooking driving process program to drive, for example, a magnetron and a turntable.

Operation of the present invention will be described with reference to FIGS. 4*a* to 4*f*.

While the microwave oven 1 is not cooking, the control and operation portion 13 displays a work menu such as the one shown in FIG. 4*a* on the display portion 9 and waits for a user to select and input a work through the input switch 11.

If the user selects "MENU" of the input switch 11, the control and operation portion 13 reads a menu of dishes the microwave oven 1 can cook, out of the storage portion 15, and displays the menu on the display portion 9 as shown in FIG. 4*b*.

If the user selects "POTATO SOUP" in the menu, the control and operation portion 13 provides a display of FIG. 4*c* to ask the user to input the kind of information the user needs.

If the user selects "NUMBER OF PERSONS" to get information about materials of the potato soup and information about quantities of the materials necessary for preparing the potato soup for a required number of persons, the control and operation portion 13 provides a display of FIG. 4*d* to ask the user to select the number of persons to be served with the potato soup. Then, FIG. 4*e* which is the same as FIG. 4*c*, is displayed.

If the user selects "MATERIAL" in FIG. 4*e*, the control and operation portion 13 executes the quantity calculating and display correcting process programs and reads names of materials necessary for making the potato soup and quantities of the materials per person, out of the storage portion 15. Then, the control and operation portion 13 calculates quantities of the materials necessary for preparing the potato soup for the required number of persons inputted previously, corrects the calculated quantities, and displays the corrected quantities as shown in FIG. 4*f*.

Figure 5:
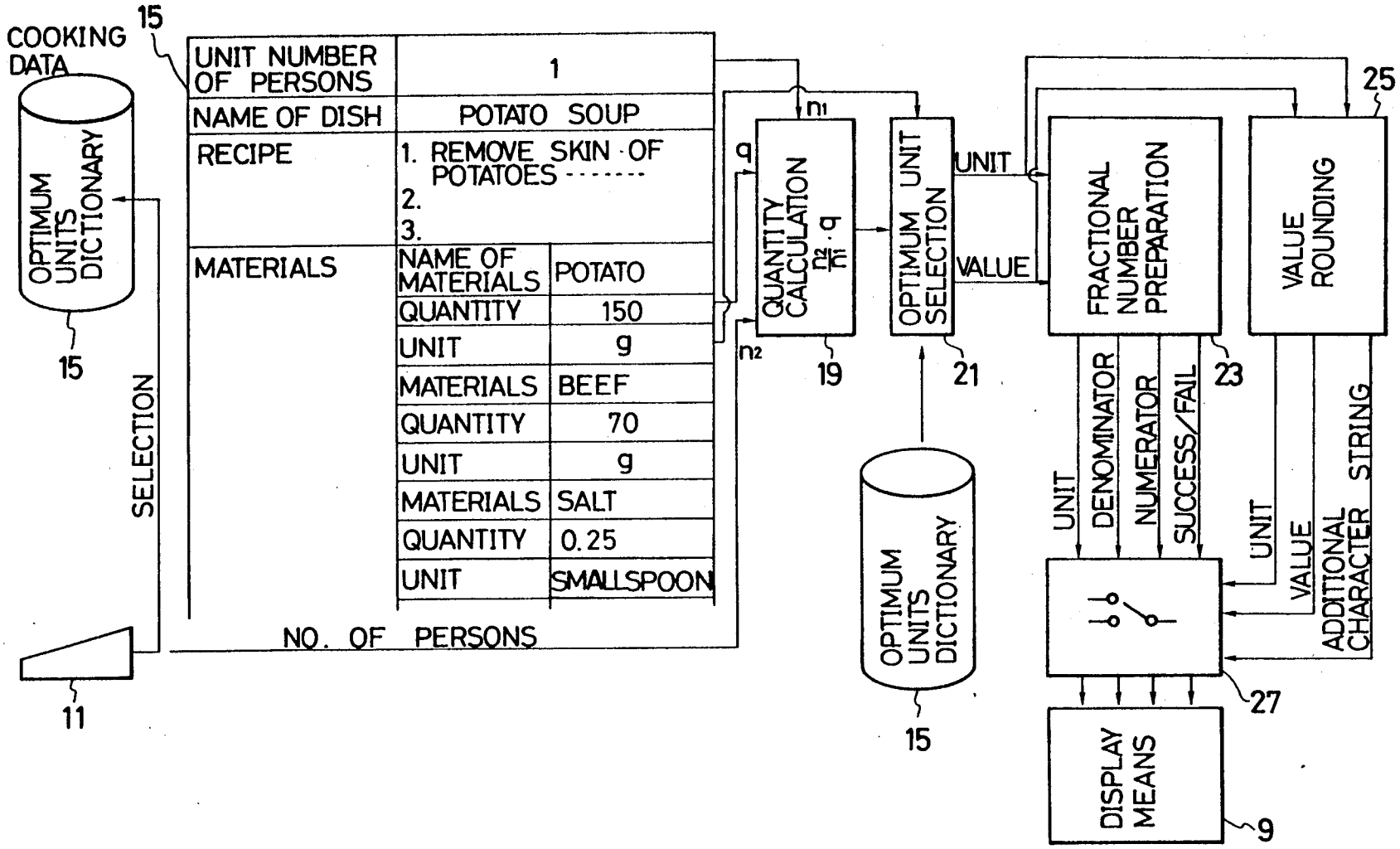
FIG. 5 is a block diagram showing the details of a flow of the display correcting process according to a first embodiment of the present invention.

As shown in FIG. 5, the quantities of the materials, etc., are calculated in Step 19 according to the inputted number of persons. Based on the calculated quantities, optimum units are selected, and values of the calculated quantities are converted into other values in Step 21 according to the selected units.

In Step 23, the quantities with the selected optimum units are changed to fractional numbers.

In Step 25, the quantities with the selected optimum units are rounded up or down. In this rounding process, character strings corresponding to the rounding up or down operations are added to the rounded up or down quantities, respectively.

In Step 27, the fractional numbers or the rounded values based on the calculated quantities are selected according to a predetermined manner and displayed.

Respective processes of the correction for providing optimum visible display data will be described.

Figure 6:
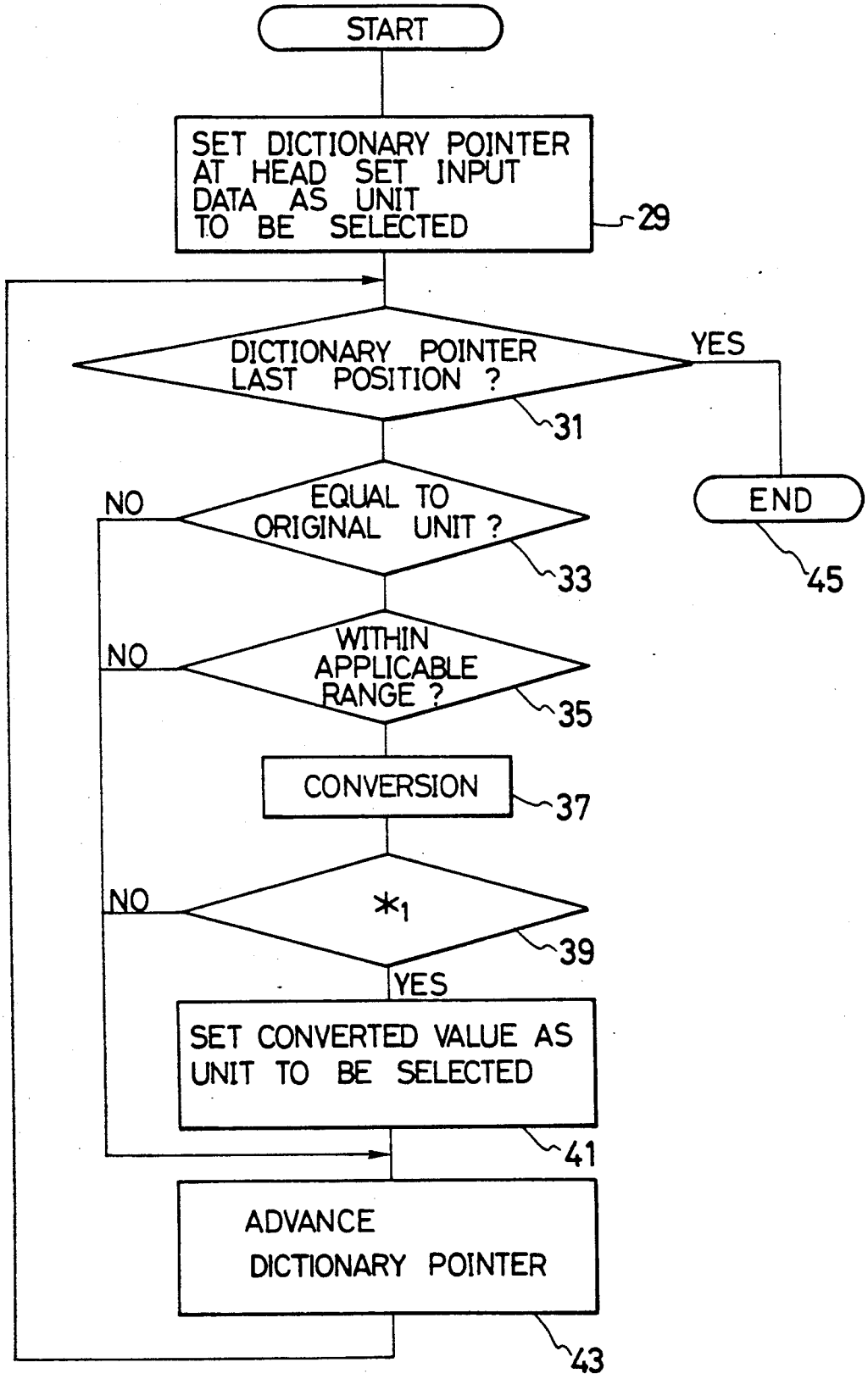
FIG. 6 is a flowchart showing an optimum unit selecting process according to the embodiment.

Firstly, the optimum unit selecting process of Step 21 will be explained with reference to a flowchart of FIG. 6

It is supposed that a calculated quantity of the soup is 1000 ml. FIG. 7 shows an example of the conversion tables stored in the storage portion 15. In Step 29 of FIG. 6, a pointer is set to the head of the conversion table of FIG. 7 to retrieve the conversion table.

In Step 31, it is judged whether or not the pointer is located at a last position. If the pointer is not located at the last position, an inputted unit "ml" for the quantity of the soup is compared with an original unit of the conversion table in Step 33. If they coincide with each other, Step 35 is carried out.

In Step 35, it is judged whether or not the inputted quantity with the unit "ml" is within an applicable range, i.e., within a range from a usable minimum value "1000" to a usable maximum value "∞". If the inputted quantity is within the applicable range, the process proceeds to Step 37.

In Step 37, the inputted quantity "1000" is converted into "1" to proceed to Step 39.

In Step 39, it is judged whether or not the value obtained in Step 37 is easy to understand for the user. Namely, the number of effective digits of the converted value "1" and that of the inputted value "1000" are compared with each other. If the number of effective digits of the converted value is smaller than that of the inputted value, the process proceeds to Step 41.

In Step 41, the converted value is adopted as a new value, and the pointer is brought forward (Step 43). Then, the process returns to Step 31.

In Step 31, if the pointer is located at the last position, the process proceeds to Step 45 to complete the optimum unit selecting process. Thus, an optimum unit "1(liter)" and the converted FIG. "1" are obtained. In Steps 33, 35 and 39, if results of the judgments are negative, Step 43 is carried out.

Figure 8:
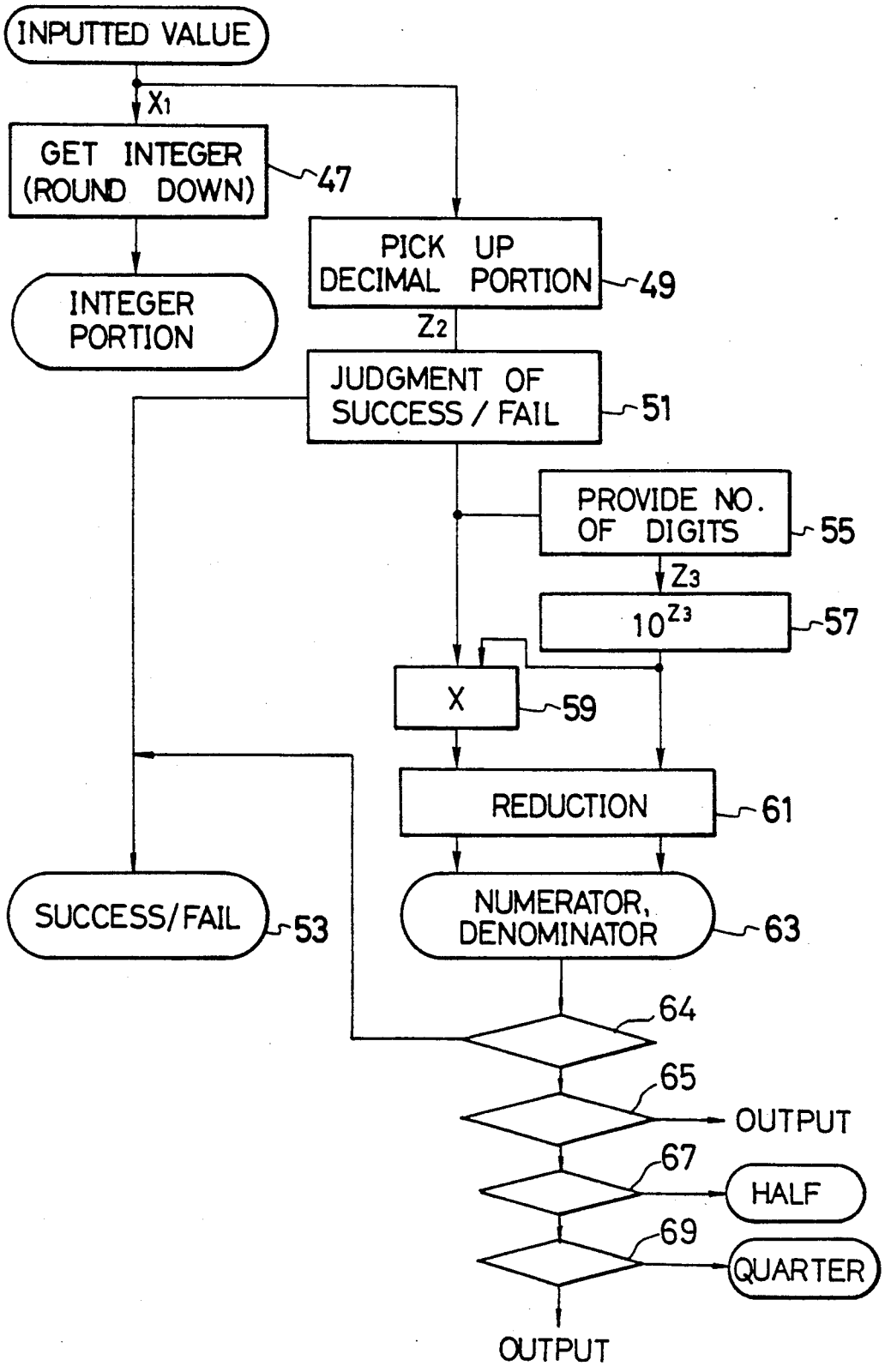
FIG. 8 is a flowchart showing a fractional number preparing process according to the embodiment.

The fractional number preparing process will be described with reference to FIG. 8.

It is supposed that a converted quantitative value of 2.25 teaspoons of salt is obtained by the optimum unit selecting process. In Step 47 of FIG. 8, an integer "2" is picked up out of the value and outputted.

In Step 49, decimals "0.25" are picked up out of the value.

In Step 51, it is judged whether or not the decimal portion is zero. If the decimal portion is zero, it is judged as a failure of preparing a fractional number, and the process proceeds to Step 53. If the decimal portion is not zero, the process proceeds to Step 55.

In Step 55, a numeral "2" of the decimal portion is detected.

In Step 57, the numeral "2" of the decimal portion is used to calculate "$10^2$".

In Step 59, a value "100" calculated in Step 57 is multiplied by the decimal portion "0.25" carried from Step 51.

In Step 61, a resultant "25 of the multiplication is set as a numerator, and the value "100" carried from Step 57 is set as a denominator. The numerator and denominator are reduced to obtain a denominator "4" and a numerator "1" in Step 63.

In Step 64, it is judged whether or not the reduced denominator has a predetermined value, in this case 2, 3, 4, 5. If the denominator is not the predetermined values, it is judged as a failure of preparing a fractional number, and the process proceeds to step 53. If the denominator is the predetermined values, the process proceeds to Step 65.

In Step 65, it is judged whether or not the reduced numerator is "1". If the numerator is not "1", the reduced denominator and numerator are outputted to provide a fractional number.

If the numerator is "1" in Step 65, it is judged whether or not the reduced denominator is "2" or "4" in Steps 67 and 69. If the reduced denominator is "2" or "4" in Steps 67 and 69. If the reduced denominator is "2", a character string "HALF" is outputted in Step 71. If the reduced denominator is "4", a character string "QUARTER" is outputted in Step 73. In the above-mentioned example, the denominator is "4" and the numerator is "1". Therefore, the character string "QUARTER" is outputted.

Moreover, in Step 61, if the decimal portion is repeating decimals, such as "0.3333333", the reduced denominator becomes "3.0000003" and the reduced numerator becomes "1". In this case, the decimal portion of the reduced denominator is neglected and the neglected denominator "3" is obtained.

Figure 9:
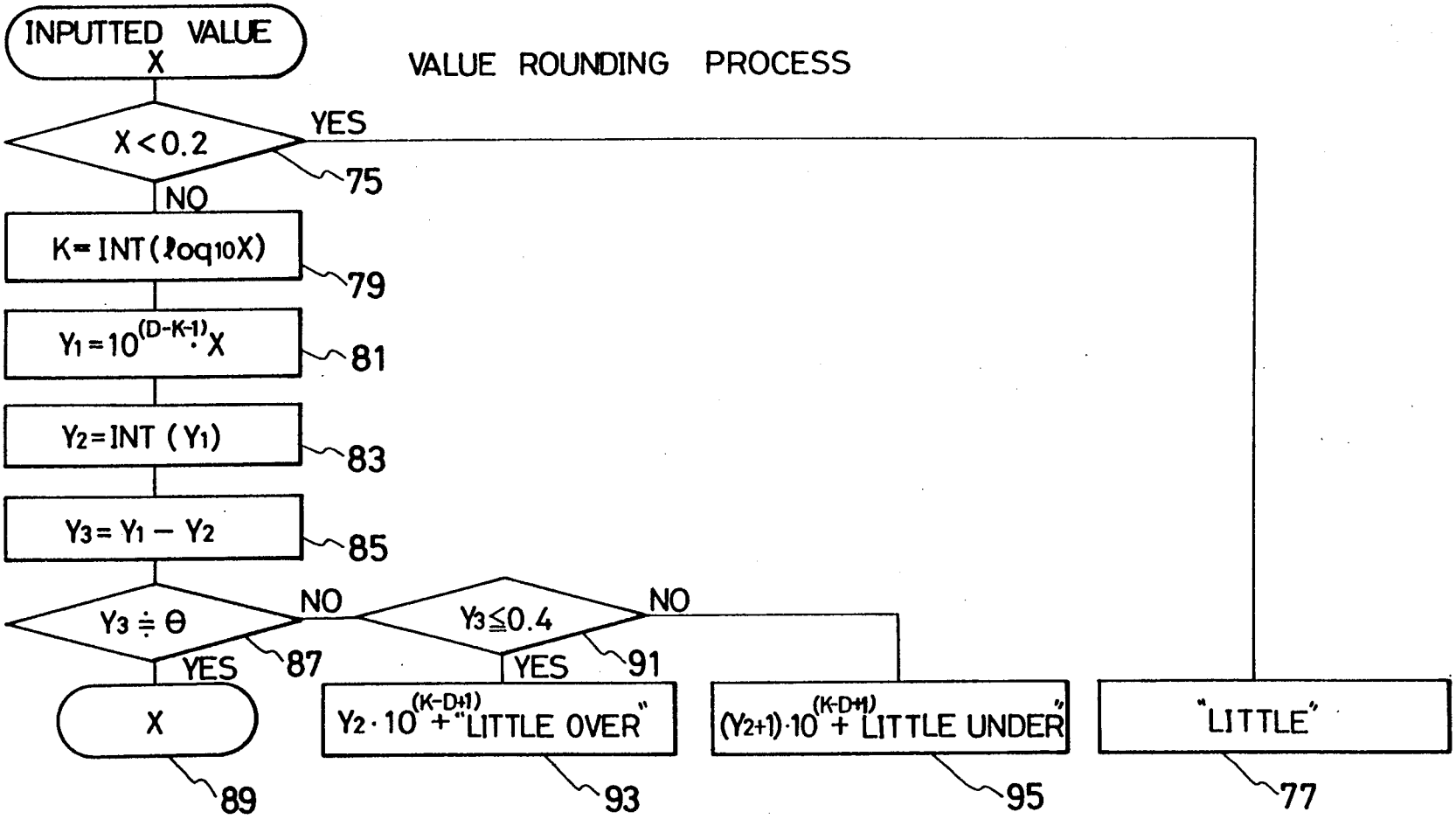
FIG. 9 is a flowchart showing a value rounding process according to the embodiment.

The value rounding process with a displayed number of digits D will be explained with reference to FIG. 9.

It is supposed that quantitative value of 1.232 tablespoons of sugar has been obtained by the optimum unit selecting process. In Step 75 of FIG. 9, it is judged whether or not the unit converted value is larger than a predetermined value "0.2". If the value is smaller than the predetermined value "0.2", the process proceeds to Step 77 to output only a character string "LITTLE" as a result of the value rounding process.

In the above-mentioned example, the unit converted value "1.232" is larger than the value "0.2" so that the process proceeds to Step 79. In this step, an equation $K=INT(\log_{10}x)$ is used to calculate the number "K" of digits of the unit converted value to obtain "K=0". Then, Step 81 is carried out.

In Steps 81, 83 and 85, equations $Y_1=10^{(D-K-1)}X=123.2$, $Y_2=INT(Y_1)=123$ and $Y_3=Y_1-Y_2$ are used to calculate $Y_3$. In this example, $Y_3=Y_1-Y_2=123.2-123=0.2$ is obtained. In Step 87, it is judged whether or not the value $Y_3$ is close to zero. If it is close to zero, it is judged as a failure of the value rounding process to proceed to Step 89.

In the above-mentioned example, the value $Y_3$ is 0.2 which is not close to zero, so that the process proceeds to Step 91. In this step, it is judged whether or not the value $Y_3$ is equal to or larger than "0.4". Since the value $Y_3$ is smaller than 0.4, Step 93 is carried out to calculate an equation $Y_2\ 10^{(K-D+1)}$ to obtain a value 1.23. To the value 1.23, a character string "LITTLE OVER" is added and outputted as a rounded value.

In Step 91, if the value $Y_3$ is larger than 0.4, Step 95 is carried out to calculate an equation $(Y_2+1)\ 10^{(K-D+1)}$ to obtain a value 1.24. To the value 1.24, a character string "LITTLE UNDER" is added and outputted as a rounded value.

As described in the above, the quantities of the materials to be cooked are displayed on the display portion 9 after carrying out the correction for providing optimum visible display data. Therefore, quantities of materials needed for cooking a predetermined dish for a required number of persons can be displayed in a manner which is understandable by the user intuitionally.

In the above-mentioned embodiment, a quantity of each food material per person has been represented with an integer and decimals. By slightly changing programs, fractional numbers for food materials may naturally be processed with the above-mentioned calculations and corrections.

Although the present invention has been described with reference to the microwave oven, the present invention is applicable for other cooking apparatuses such as electronic rice cookers.

In the embodiment, the cooking information has only been display data to be displayed on the display portion 9. However, voice information may also be used to improve convenience.

In the embodiment, the number of persons to be served has been designated with an integer as shown in FIG. 4*d*. However, ten keys may be provided for the cooking apparatus to designate the number of persons in more detailed manner such as 1.3 persons.

Various modifications will become possible for those skilled in the art after receiving the teachings of the present disclosure without departing from the scope thereof.

What is claimed is:

1. A method of displaying suitable quantities of materials necessary for preparing each dish to be cooked in a cooking apparatus, comprising a control system for processing data for said dish and a display device for displaying information derived from the data, said method comprising the steps of:

(a) calculating quantities of materials necessary for preparing the dish for an indicated number of persons in accordance with the quantities of materials per person stored in a cooking information storage means of the cooking apparatus;

(b) converting the calculated quantities of the materials associated with a first unit to equivalent quantities represented by fewer effective digits associated with a second unit different than said first unit as a first display information;

(c) separating a decimal portion of the first display information from an integral portion, converting the decimal portion to a proper fraction, and adding the fraction to the integral portion to obtain second display information;

(d) dropping the digits of said first display information expressed in the decimal number system to obtain third display information; and (e) selecting one of the first, second, and third display information and displaying on a display the selected display information, said steps (b), (c), (d) and (e) being performed by said control system.

2. A cooking apparatus having predetermined cooking functions, comprising:

cooking information storage means for storing names of materials necessary for preparing each dish to be cooked by the cooking apparatus and quantities of the materials needed for preparing the dish per person;

display means for displaying at least the quantities of the materials;

input means for inputting the number of persons to be served with a required dish to be cooked by the apparatus;

operating means for calculating quantities of the materials necessary for preparing the dish for the number of persons inputted through said input means, according to the quantities of the materials per person stored in said cooking information storage means; and display data correction means for correcting the quantities calculated by said operating means to provide equivalent quantities represented by fewer effective digits than with said first uncorrected quantities;

wherein the correcting operation carried out by said display data correction means comprises a value rounding means for rounding up or down values of the respective quantities of the materials calculated according to the inputted number of persons, and adding character strings corresponding to the rounding up or down operations to the value being rounded up or down.

3. The cooking apparatus as claimed in claim 2, wherein the correcting operation carried out by said display data correction means comprises:

an easily understood unit selecting means for selecting units for the respective quantities of the materials calculated according to the inputted number of persons, and converting values of the calculated quantities into other values according to the selected optimum units; and a fractional number preparing means for preparing fractional numbers corresponding to the respective quantities of the materials calculated according to the inputted number of persons or a value rounding process for rounding up or down the respective quantities of the materials calculated and according to the inputted number of persons and adding character strings corresponding to the rounding up or down operations to the values which have been rounded up or down.

4. The cooking apparatus as claimed in claim 2, wherein each of the character strings corresponding to the rounding up or down operations is one of "little", "little over" and "little under".

* * * * *